United States Patent [19]

Young et al.

[11] Patent Number: 4,989,858

[45] Date of Patent: Feb. 5, 1991

[54] APPARATUS FOR EXERCISING BOTH ARMS AND LEGS

[75] Inventors: Dow W. Young, Santa Clara; Marcus B. Sorenson, St. George; Gary B. Young, Monticello, all of Utah

[73] Assignee: Cardio-Fit, Inc., Santa Clara, Utah

[21] Appl. No.: 472,359

[22] Filed: Jan. 29, 1990

[51] Int. Cl.[5] ..... A63B 21/00

[52] U.S. Cl. ..... 272/70; 272/130; 272/126

[58] Field of Search ..... 272/70, 130, 126, 96, 272/120, 97

[56] References Cited

U.S. PATENT DOCUMENTS

| | | | |
|---|---|---|---|
| 3,566,861 | 3/1971 | Weiss | 272/70 |
| 4,645,200 | 2/1987 | Hix | 272/126 |
| 4,709,918 | 12/1987 | Grinblat | 272/70 |
| 4,830,362 | 5/1989 | Bull | 272/70 |
| 4,838,543 | 6/1989 | Armstrong et al. | 272/70 |
| 4,940,233 | 7/1990 | Bull et al. | 272/70 |

*Primary Examiner*—Stephen R. Crow
*Attorney, Agent, or Firm*—K. S. Cornaby

[57] ABSTRACT

A combination arm and leg exercising apparatus has a base member adapted to rest upon a floor and a support frame extending upwardly therefrom. The support frame has a pair of foot pedals pivotally attached thereto at one respective end of each foot pedal. A cross member attached to the upper end of the support frame has a pair of independently articulated pivotal arm handles rotatably attached to the cross-member. A pair of adjustable compressed spring tension devices are attached respectively between each foot pedal and the upper cross member. A pair of actuating rods are pivotally attached respectively between each foot pedal and each arm handle, so that movement of either the arm handle or the foot pedal actuates the other member. Each of the two foot pedal—arm handle combinations is independently actuated, and not dependent on the other for movement.

6 Claims, 3 Drawing Sheets

APPARATUS FOR EXERCISING BOTH ARMS AND LEGS

BACKGROUND OF THE INVENTION

This invention relates to an exercise apparatus for exercising both arms and legs in tandem.

It has long been known that physical exercise has a beneficial effect on the human body. To this end, those who promote good health have advocated some form of physical exercise to maintain the organs and muscles of the body in a healthy condition.

In most cases, walking, jogging or bicycling provides stimulating exercise for the limbs and vital organs, particularly the heart and lungs. However, as the pace of life for many persons, especially those who tend to have indoor, high stress lifestyles, has increased, the time demands of such lifestyles has not allowed these individuals the luxury of open-air jogging or running. Moreover, in some cases, physicians have discovered that the constant pounding associated with jogging or running has caused damage to knees, ankles, feet and hips. Also, while running and jogging exercises the legs, heart and lungs, the arms assume a passive role in such exercise. That is, the arms move forward and backward as a person walks or runs, but do not perform work or exercise against a positive resistance.

As the public became aware of the limitations of walking and running as a convenient form of exercise, exercising apparatuses began to be developed, in many cases being modeled after the training methods used by body building enthusiasts for developing muscle tone for a variety of body muscles. Such apparatuses were designed to take into account that most users had limited time and opportunity for out-door running or walking or desired the convenience of exercising in the home or at an indoor location near to the work place.

A number of exercise machines were developed to provide specific exercise for certain body organs and muscles. For example, stationary exercise bicycles exercise the legs, heart and lungs. Stationary treadmills exercise similar muscles and organs; while stationary rowing machines enable the user to exercise the upper torso, especially the arms and shoulders. So-called stair-climbing devices were developed to provide exercise for the legs, heart and lungs. As illustrated in U.S. Pat. Nos. 4,838,543 and 4,685,666, devices generally called for a support bar for the arms and hands to steady the user, while the legs were exercised by an alternative pumping or stair-climbing motion on reciprocating pedals designed to simulate the climbing of stairs. This action also provided excellent heart and lung exercise.

As the concept of a stair-climbing device began to be refined, the stationary support bar for arms and hands gave way to reciprocating handle bars movingly attached to the foot pedals of the stair-climbing apparatus. Such a device is disclosed in U.S. Pat. No. 4,830,362 wherein a tracker-action connection between the reciprocating pedals of the stair-climbing devise induced a reciprocating movement in a pair of vertically-oriented handles to provide passive tracking exercise for the arms. That is, the Positive reciprocating action of the foot pedals by the user resulted in a following or tracking action in the arm handles. The user could optionally hold onto the reciprocating arm handles for passive exercise, or could manipulate the foot pedals without holding onto the handles for leg exercise alone.

Such a devise still did not provide a positive resistance to the arms to exercise the arms in a manner similar to the legs.

It was therefore an objective of this invention to provide an exercise apparatus for positively exercising both arms and legs.

It was also an objective to provide positive resistance to the arms in a combination arm and leg exercising apparatus.

It was a further objective to provide a combination arm and leg exercising apparatus which required positive arm movement in order to operate the exercise apparatus.

SUMMARY OF THE INVENTION

The objectives of this invention are met by a combination arm and leg exercising apparatus having a floor support base member to which is attached an upright vertical support frame. The support frame has means for movably attaching the respective ends of the foot pedals which extend therefrom along the base member. A pair vertically oriented rods are attached at respective first ends thereof to the respective foot pedals. The opposite respective ends of the vertical rods are attached to respective arm handles, so that as each foot pedal is reciprocated, the corresponding arm handle moves. The corresponding arm handle and foot pedal are connected such that positive action by pulling the arm handle back toward the body is required to move the foot pedal in an upward direction from the lower rest position. The movement of the opposite pedal in a downward direction does not move the opposite pedal upwardly. That upward movement is only accomplished by the positive movement of the corresponding arm handle, thereby providing positive resistance for the arms and the legs.

In a preferred embodiment, the foot pedals have adjustable spring tension means, such as shock absorbers, to adjust the degree of tension or force required to move the foot pedals and arm handles. Another preferred embodiment has a collapsible frame for portability of the exercise apparatus.

THE DRAWING

A preferred embodiment of this invention is illustrated in the accompanying drawing, in which:

FIG. 1 is a perspective view of the exercise apparatus;

FIG. 2, a side elevational view of the apparatus shown in FIG. 1.

FIG. 3, an end elevational view of the apparatus shown in FIG. 1.

FIG. 4, a sectional perspective showing the attachment of the foot pedals and vertical rods to the support frame;

FIG. 5, a sectional perspective showing the attachment of the vertical rods and arm handles to the support frame;

FIG. 6, another embodiment of the exercise apparatus, showing the support frame with a hinging device for collapsing the frame for portability; and FIG. 7, a side elevational view of the exercise apparatus shown in FIG. 6 in a collapsed, portable state.

DETAILED DESCRIPTION OF THE ILLUSTRATED EMBODIMENTS

Figure 1:
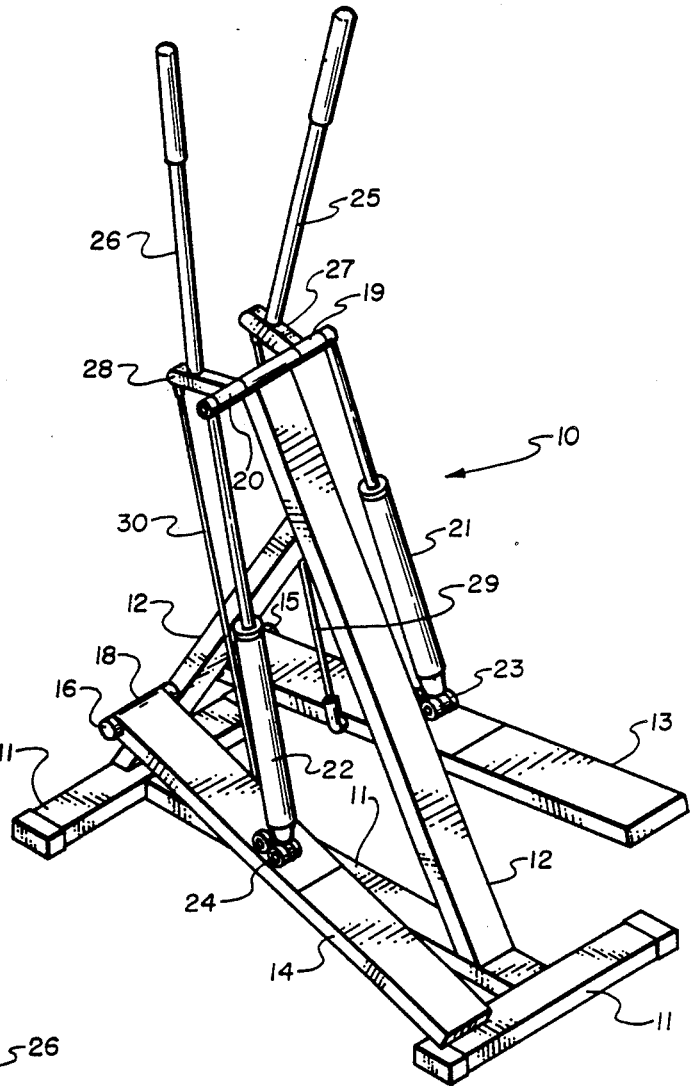
Figure 3:
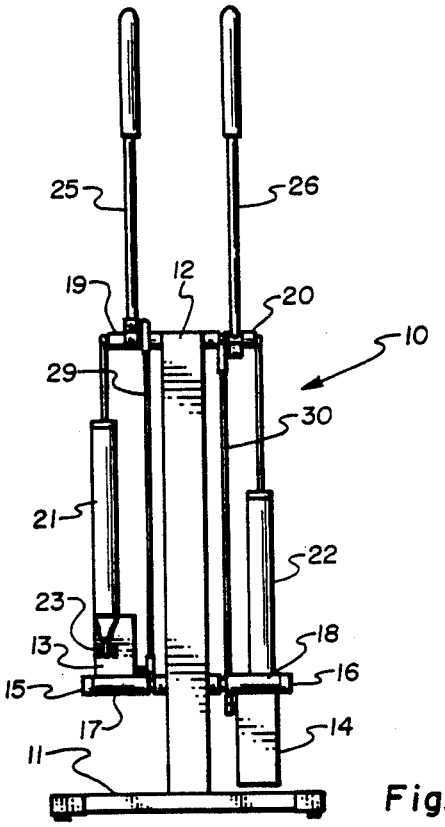

As shown in FIG. 1, an exercise apparatus 10 of the invention of has a base member 11 designed to rest on a substrate, such as a floor or the like. A support frame 12, which in this embodiment comprises a pair of struts connected at the upper ends thereof, extends upwardly from connection with the base member 11. Both base member 11 and support frame 12 are preferably constructed of metal or the like to withstand the stress of continued usage of the apparatus 10.

A pair of foot pedals 13, 14 are movably attached at respective ends of the pedals to the support structure 12 by means of a pair of respective rod extensions 15, 16, extending laterally outwardly from the support structure 12. Rod extensions 15, 16 are adapted to accommodate pivotable end sleeves 17, 18 on the respective ends of foot pedals 13, 14, so that food pedals 13, 14 can rotate about rod extensions 15, 16 as the foot pedals reciprocate upwardly and downwardly about the pivot points of rod extensions 15, 16.

Figure 2:
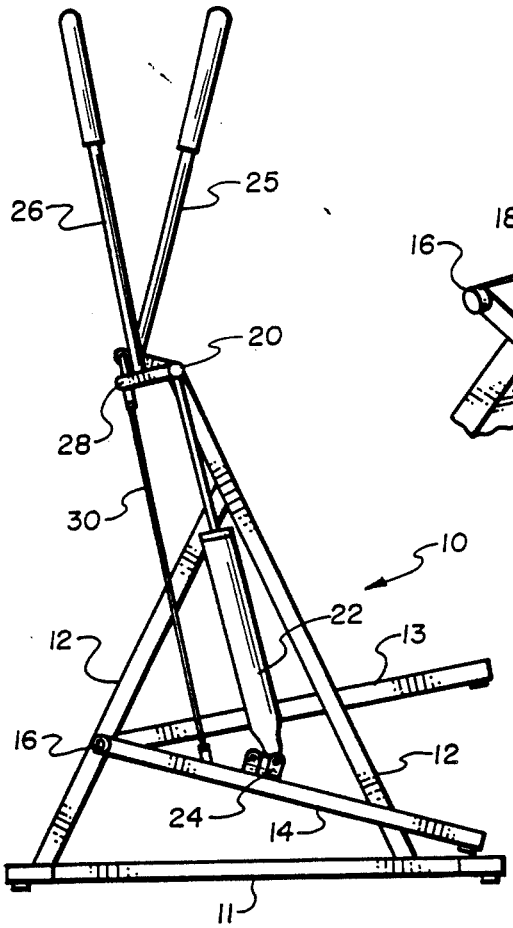
Figure 4:
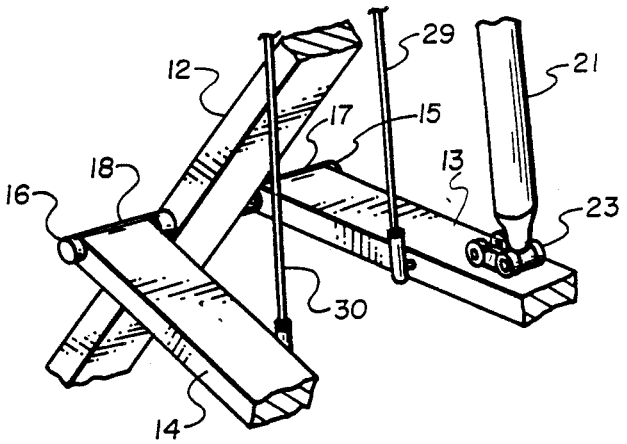
Figure 5:
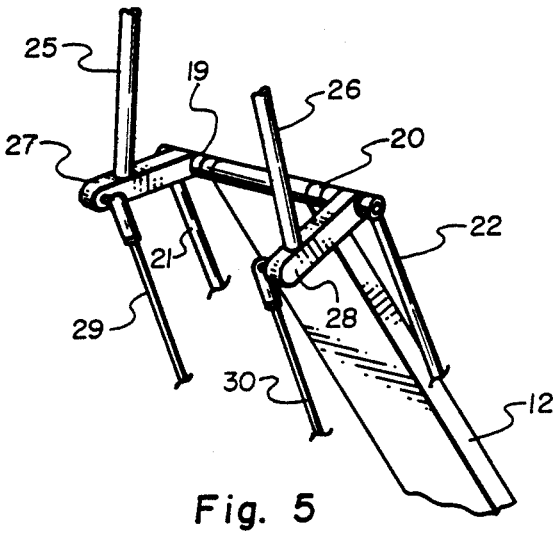

As shown in FIGS. 1, 2, 3, 4, and 5, foot pedals 13, 14 are attached respectively to a pair of laterally extending pivot posts 19, 20 attached to the upper end of support frame 12. A pair of adjustable compressed spring cylinders or shock absorbers 21, 22 are attached respectively at one end thereof to each foot pedal 13, 14 by means of a rotatable coupling 23, 24 attached to foot pedals 13, 14 as shown in FIGS. 1, 2, and 4, the rotatable coupling 23, 24 comprises in this embodiment a pair of couplings on each foot pedal, so that the shock absorbers 21, 22 can be attached to the respective foot pedals at two different locations on the foot pedal depending on the length of the shock absorber and the desired height of the foot pedals 13, 14 above base member 11.

At the upper ends of shock absorbers 21, 22, their respective upper ends are pivotably attached to laterally extending pivot rods 19, 20 for upper support of foot pedals 13, 14. Shock absorbers 21, 22 are adjustable with respect to ease of movement to accommodate a user's desire for increased and decreased resistance to foot pedal 13, 14 travel about pivot rods 15, 16.

A pair of arm handles 25, 26 are fixedly attached respectively to a pair of rearward extending extension tabs 27, 28, which are rotatably attached to laterally extending pivot posts 19, 20. The handles 25, 26 extend upwardly and are adapted to be grasped by the exerciser when using the exercise apparatus.

A pair of accurating rods 29, 30 are pivotally attached at both ends thereof respectively to rearward extending tabs 27, 28 and to foot pedals 13, 14. Rods 29, 30 are preferably attached to foot pedals 13, 14 approximately midway between pivotal attachment sleeves 17, 18 and shock absorber attachment brackets 23, 24; and are designed to tie the action of foot pedals 13, 14 with that of corresponding arm handles 25, 26. As a foot pedal is lowered toward the base member, the corresponding arm handle is moved rearwardly; conversely, the movement of the arm handle forward raises the corresponding foot pedal. Accordingly, it is necessary to positively pull each arm handle forward in order to raise the corresponding foot pedal. In use, the arm handles 25, 26 are alternatively pulled forward to raise the corresponding foot pedals 13, 14. As weight is placed on each alternate foot pedal, the corresponding arm handle is moved rearwardly of the apparatus.

Such alternating use of each foot pedal - arm handle combination approximates the stair-climbing exercise with an accompanying arm exercise as in cross-country skiing. This combination motion of both arms and legs can be referred to as "cross-country climbing." It is not possible to raise a foot pedal without pulling forward on the corresponding arm handle. The construction management allowing the pushing of the arm handle rearward to lift the corresponding foot pedal is an alternative to the illustrated construction shown in FIGS. 1–5.

Figure 6:
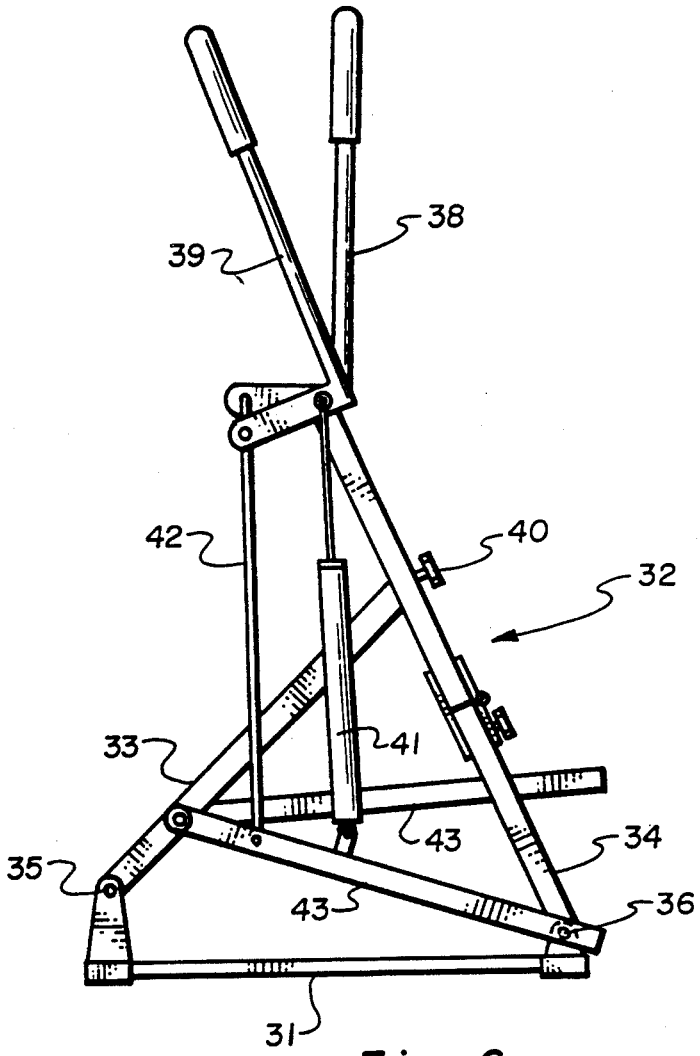
Figure 7:
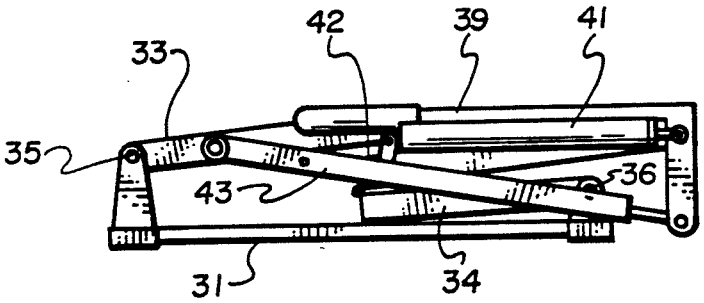

An additional alternative embodiment of this invention is illustrated in FIGS. 6 and 7 for use as a collapsible or portable exercise apparatus. As shown in FIGS. 6, 7,, a base member 31 can have cross-members which are bolted in place, rather than welded, for ease of disassembly. A support frame 32 has a pair of upstanding frame members 33, 34 which are hingedly attached at their lower ends 35, 36 to base member 31. Frame member 34 is hinged with a securing knob at a point 37 above lower end 36, so that when collapsed as shown in FIG. 7, the upper part of frame member 34 folds forward of the apparatus to bring arm handles 38, 39 down and above base member 31.

The two frame members 33, 34 are disconnectable from each other at their upPer ends by means of a securing knob 40. The respective shock absorbers 41 actuating rods 42, and foot pedals 43 are also lowered to a location above base member 31 for a compact, portable apparatus as depicted in FIG. 7.

While this invention has been described with reference to preferred embodiments illustrated in the accompanying drawings and described in the attached claims, it is intended that substantial equivalents apparent to those skilled in the art are included within the scope of this invention.

We claim:

1. A combination arm and leg exercising apparatus comprising in combination:

a horizontal base member;

an upright support frame attached at its lower end to said base member;

a pair of foot pedals pivotally attached at one respective end thereof to said support frame for vertical reciprocating motion;

a cross member attached to the upper end of said support frame;

a pair of upwardly extending arm handles pivotally attached at one respective end thereof to said cross member for reciprocating motion;

a pair of actuating rods pivotally attached at one respective end thereof to said arm handles and at the other respective end to said foot pedals, so that as an arm handle is reciprocatingly moved, the corresponding foot pedal is reciprocatingly moved through said actuating rod independently of the other foot pedal; and a pair of tensioning means pivotally attached at one end thereof respectively to said upright support frame and at the other end thereof respectively to said foot pedals.

2. An exercise apparatus as set forth in claim 1, wherein the tensioning means is a shock absorber.

3. An exercise apparatus as set forth in claim 1, wherein said upright support frame has a pair of support members arranged in a triangle configuration with one upper side of the triangle extending above the apex.

4. An exercise apparatus as set forth in claim 1, wherein the support frame is hinged with respect to attachment with the base member for folding down in a collapsed position over the base member.

5. An exercise apparatus as set forth in claim 1, wherein said pair of tensioning means are respectively attached at one end thereof to said cross member adjacent to the attachment of said arm handles.

6. An exercise apparatus as set forth in claim 1, wherein said pair of actuating rods are respectively attached at one end to said foot pedals at a point in closer proximity to the point of attachment of said tensioning means than the pivotal attachment point of the respective end of the foot pedals.

* * * * *